US011203460B2

(12) United States Patent
Hokanson

(10) Patent No.: US 11,203,460 B2
(45) Date of Patent: Dec. 21, 2021

(54) MULTI-CARTON CONTAINER

(71) Applicant: Kimberly-Clark Worldwide, Inc., Neenah, WI (US)

(72) Inventor: Brandon Mark Hokanson, Menomonie, WI (US)

( * ) Notice: Subject to any disclaimer, the term of this patent is extended or adjusted under 35 U.S.C. 154(b) by 0 days.

(21) Appl. No.: 16/645,541

(22) PCT Filed: Oct. 27, 2017

(86) PCT No.: PCT/US2017/058733
§ 371 (c)(1),
(2) Date: Mar. 9, 2020

(87) PCT Pub. No.: WO2019/083543
PCT Pub. Date: May 2, 2019

(65) Prior Publication Data

US 2020/0262607 A1 Aug. 20, 2020

(51) Int. Cl.
*B65D 5/54* (2006.01)
*B65D 5/72* (2006.01)

(52) U.S. Cl.
CPC ..... *B65D 5/5495* (2013.01); *B65D 5/725* (2013.01)

(58) Field of Classification Search
CPC ..... B65D 5/5495; B65D 5/725; B65D 5/427; B65D 5/5445; B65D 71/00
USPC ..... 229/120.011, 120.03, 120.01; 206/192, 206/256, 820
See application file for complete search history.

(56) References Cited

U.S. PATENT DOCUMENTS 2,684,178 A 7/1954 Keeler
2,737,334 A 3/1956 Halgren
3,048,321 A 8/1962 Sanford
3,135,457 A 6/1964 Risucci
3,144,190 A * 8/1964 Holt ..... B65D 5/48002 229/120.17
3,158,312 A 11/1964 Simkins
3,166,229 A * 1/1965 Sherman ..... B65D 5/542 229/242
3,510,046 A * 5/1970 Reiner ..... B65D 5/5495 229/120.18
4,179,061 A * 12/1979 Gilbert ..... B65D 5/48014 229/117.16
4,377,237 A 3/1983 Pawlowski
4,398,661 A * 8/1983 Schillinger ..... B65D 5/48014 229/120.03
4,467,923 A 8/1984 Dornbusch et al.
(Continued)

FOREIGN PATENT DOCUMENTS

DE 102008015079 B4 12/2010
WO 06001039 A1 1/2006

OTHER PUBLICATIONS

Yu, Virginia, "CL9UD Tissue Packaging on Behance", Jan. 26, 2017, https://www.behance.net/gallery/11804613/CL9UD-TISSUE-PACKAGING.

(Continued)

*Primary Examiner* — Christopher R Demeree

(57) ABSTRACT

A multi-carton container can be separated into a first carton and a second carton. The top wall of each of the first carton and the second carton can be at least partially connected to each other along a line of weakness. Side walls of each of the first carton and the second carton can also be at least partially connected to each other along lines of weakness.

10 Claims, 4 Drawing Sheets

(56) References Cited

U.S. PATENT DOCUMENTS

| | | | | |
|---|---|---|---|---|
| 4,533,052 | A * | 8/1985 | Fruchey | B65D 5/5495 206/805 |
| 4,574,952 | A | 3/1986 | Masui | |
| 4,913,291 | A | 4/1990 | Schuster | |
| 5,141,106 | A | 8/1992 | Adams et al. | |
| 5,318,223 | A | 6/1994 | Gale | |
| 5,505,370 | A | 4/1996 | Brown et al. | |
| 5,579,911 | A | 12/1996 | Werth | |
| 5,645,163 | A | 7/1997 | Werth | |
| 5,722,583 | A | 3/1998 | Focke et al. | |
| 6,006,982 | A | 12/1999 | Jones | |
| 6,729,475 | B2 | 5/2004 | Yuhas et al. | |
| 6,913,189 | B2 | 7/2005 | Oliff et al. | |
| 2010/0206944 | A1 | 8/2010 | Bates et al. | |
| 2014/0076915 | A1 | 3/2014 | Becherer et al. | |
| 2016/0145020 | A1 | 5/2016 | Ramsuer et al. | |

OTHER PUBLICATIONS

Bio Laboratories, "Twin Wet & Dry Tissues Box", Jan. 25, 2017, http://www.bio-labs.co.uk/index.php/twin-wet-and-dry-tissues-box.html.

* cited by examiner

MULTI-CARTON CONTAINER

BACKGROUND OF THE DISCLOSURE

In many instances, an individual consumer product is packaged, displayed on a retail shelf, and sold to a consumer while being housed in its own individual consumer product packaging. In many instances, multiple consumer products are packaged, displayed on a retail shelf, and sold to a consumer while being housed in a single common consumer product package. At various moments in the retail life cycle of consumer products, a manufacture may desire to promote the sale of multiple consumer product packages of the same consumer product. At various moments, a consumer may have a desire to purchase more consumer products than the allotment contained within a single consumer product package. For these moments, a manufacturer may find it desirable to group the individual consumer product packages together and attach them to each other. Such methods of attachment can include taping the individual consumer product packages together or wrapping a banding material around the grouped individual consumer product packages. Another example of a method to contain individual consumer product packages as a single common sales unit is to wrap the multiple consumer product packages with a material, such as cellophane, plastic wrap, or a cardboard overwrap. Each of these methods, however, entails the use of additional materials which can increase the overall costs and processing expenses. Another drawback to such methods can include the deterioration of the overall image of the consumer product package on the retail shelf to the consumer. Such deterioration can include obstruction of the graphics printed on the consumer product package, graphics printed on an overwrapping material may overlap with and/or be out-of-sync with graphics printed on the consumer product package, graphics printed on an overwrapping material may not be of sufficient quality if the material is not as receptive to printing graphics as the material forming the base consumer product package.

While manufacturers and consumers may both desire combinability of separate and individual consumer product packages, manufacturers and consumers both generally desire the ability to separate such a combined package. For example, a manufacturer may desire the combinability of individual consumer product packages for shipping, distribution, and display purposes. Additionally, a consumer may desire the combinability of individual consumer product packages for ease in transport of the product home from the retail store, ability to have more product, and/or a potential lower cost to the consumer to purchase items in bulk. Once the product reaches its intended destination, such as a retail shelf or the consumer's home, there may be a desire to separate the multiple carton into its individual cartons, such as for individual sale (as in a retail environment) or individual usage (such as in a home environment).

There remains a need for an improved multi-carton container which can be separated into individual cartons for individual usage.

SUMMARY OF THE DISCLOSURE

In various embodiments, a multi-carton container can have a first carton comprising a first top wall, a first bottom wall, a first inside wall, and a first outside wall, the first top wall being parallel to the first bottom wall and perpendicular to each of the first inside wall and the first outer wall, a first outermost side wall panel connected to the first top wall along a first fold line, a second outermost side wall panel connected to the first top wall along a second fold line, the first outermost side wall panel and the second outermost side wall panel each being perpendicular to the first top wall; a second carton comprising a second top wall, a second bottom wall, a second inside wall, and a second outside wall, the second top wall being parallel to the second bottom wall and perpendicular to each of the second inside wall and the second outer wall, a third outermost side wall panel connected to the second top wall along a third fold line, a fourth outermost side wall panel connected to the second top wall along a fourth fold line, the third outermost side wall panel and the fourth outermost side wall panel each being perpendicular to the second top wall; wherein the first top wall is at least partially connected to the second top wall along a first line of weakness and wherein the first outermost side wall panel is at least partially connected to the third outermost side wall panel along a second line of weakness, and wherein the second outermost side wall panel is at least partially connected to the fourth outermost side wall panel along a third line of weakness; wherein the first top panel has a first removable portion to reveal a first dispensing opening and wherein the second top panel has a second removable portion to reveal a second dispensing opening.

In various embodiments, the first top wall has a first length dimension and the second top wall has a second length dimension and wherein the connection between the first top wall and the second top wall is less than full length dimension of each of the first top wall and the second top wall. In various embodiments, the first outermost side wall panel has a third length dimension and the third outermost side wall panel has a fourth length dimension and wherein the connection between the first outermost side wall panel and the third outermost side wall panel is less than the full length dimension of each of the first outermost side wall panel and the third outermost side wall panel. In various embodiments, the second outermost side wall panel has a fifth length dimension and the fourth outermost side wall panel has a sixth length dimension and wherein the connection between the second outermost side wall panel and the fourth outermost side wall panel is less than the full length dimension of each of the second outermost side wall panel and the fourth outermost side wall panel.

In various embodiments, the first inside wall is hingedly connected to a first flange and wherein the first flange is attached to the first top panel. In various embodiments, the second inside wall is hingedly connected to a second flange and wherein the second flange is attached to the second top panel.

In various embodiments, the first line of weakness is formed by separation elements. In various embodiments, the first line of weakness comprises a pair of parallel lines of weakness forming a tear strip.

In various embodiments, the container is made from a single blank.

In various embodiments, the first removable portion comprises a notch. In various embodiments, the second removable portion comprises a notch.

In various embodiments, the first carton further comprises a first barrier positioned over the first dispensing opening. In various embodiments, the second carton further comprises a second barrier positioned over the second dispensing opening.

Figure 1:
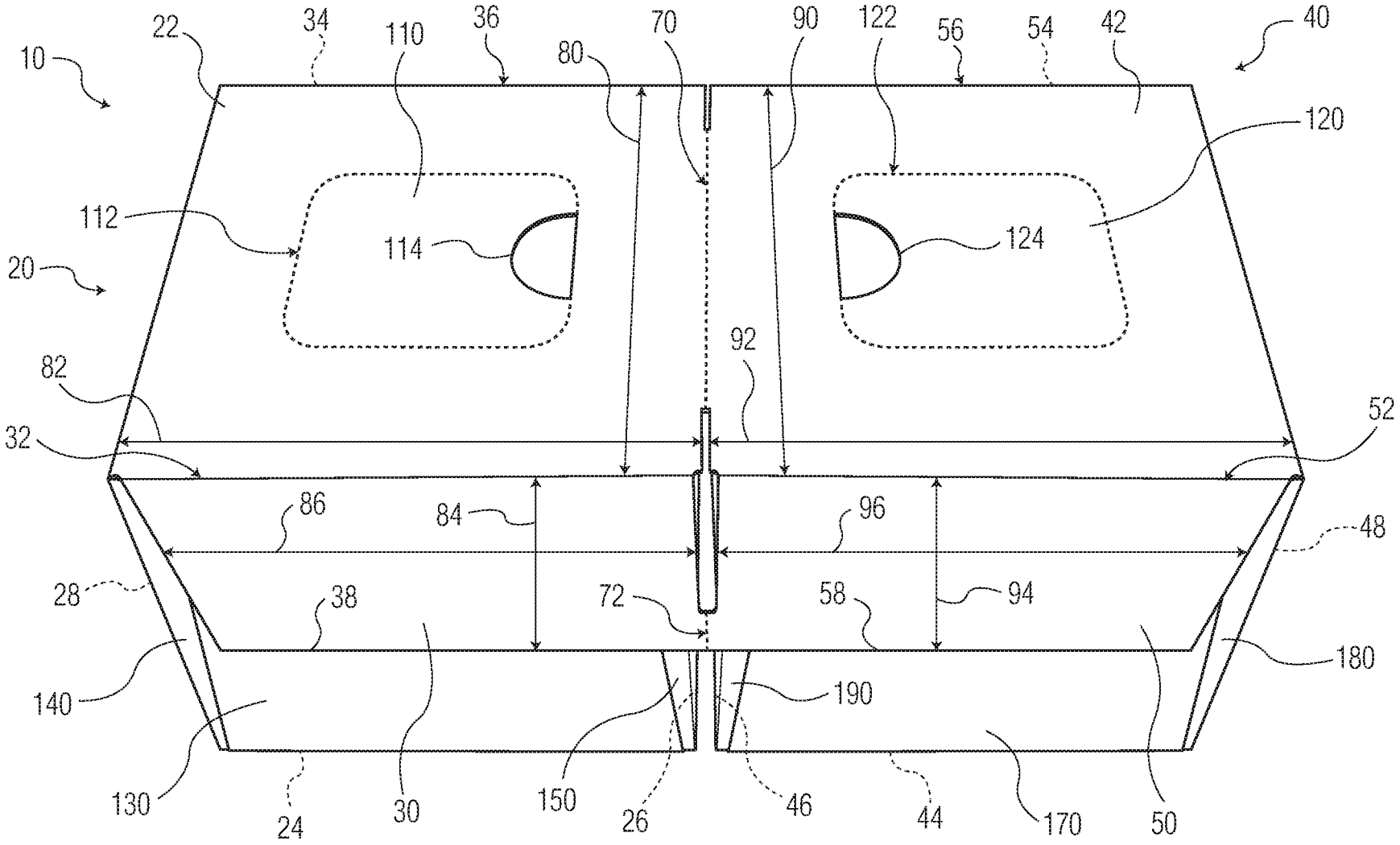
FIG. 1 is a perspective view of an embodiment of a multi-carton container.

Repeat use of reference characters in the present specification and drawings is intended to represent the same or analogous features or elements of the disclosure.

DETAILED DESCRIPTION OF THE DISCLOSURE

Figure 2:
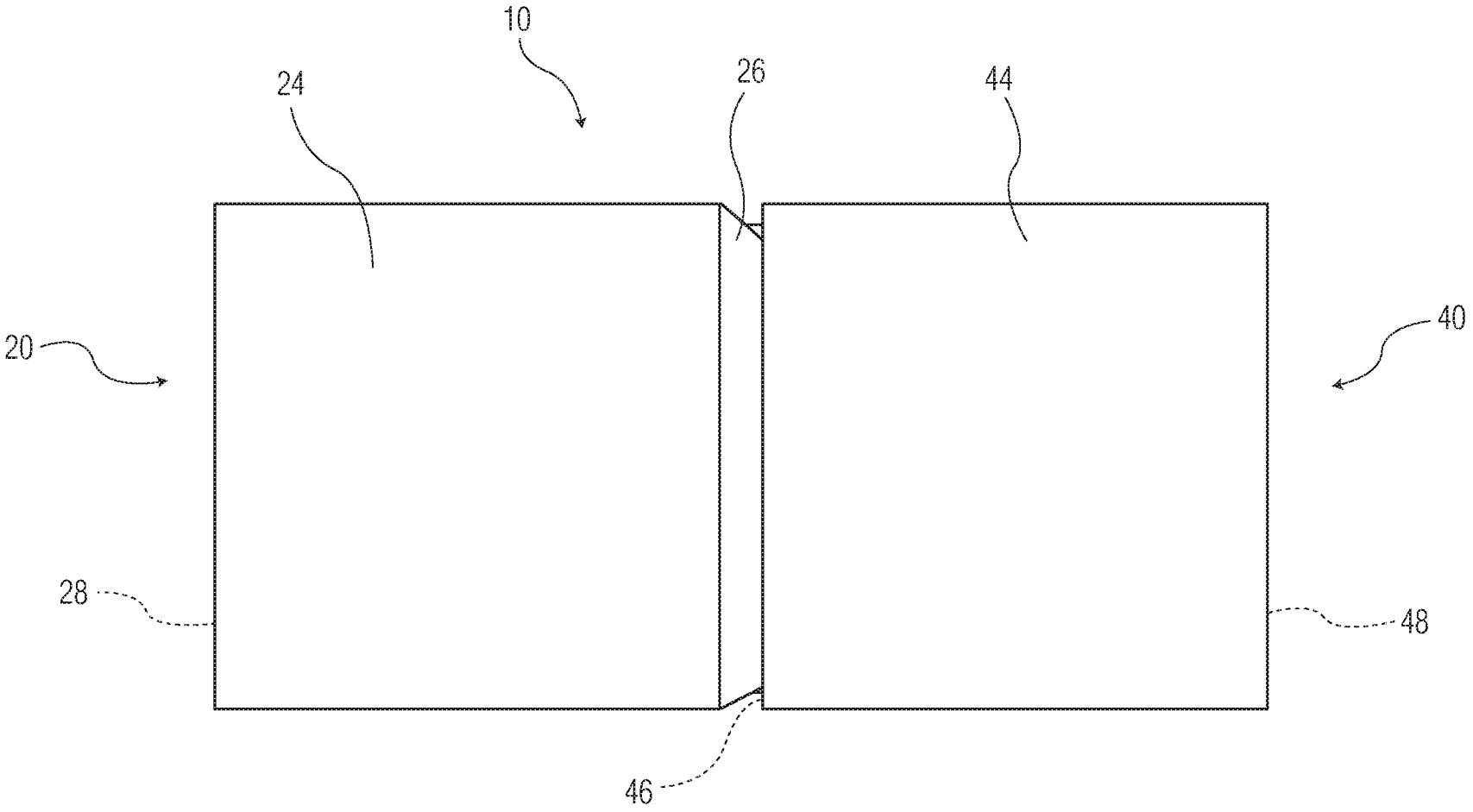
FIG. 2 is a bottom view of the multi-carton container of FIG. 1.
Figure 3:
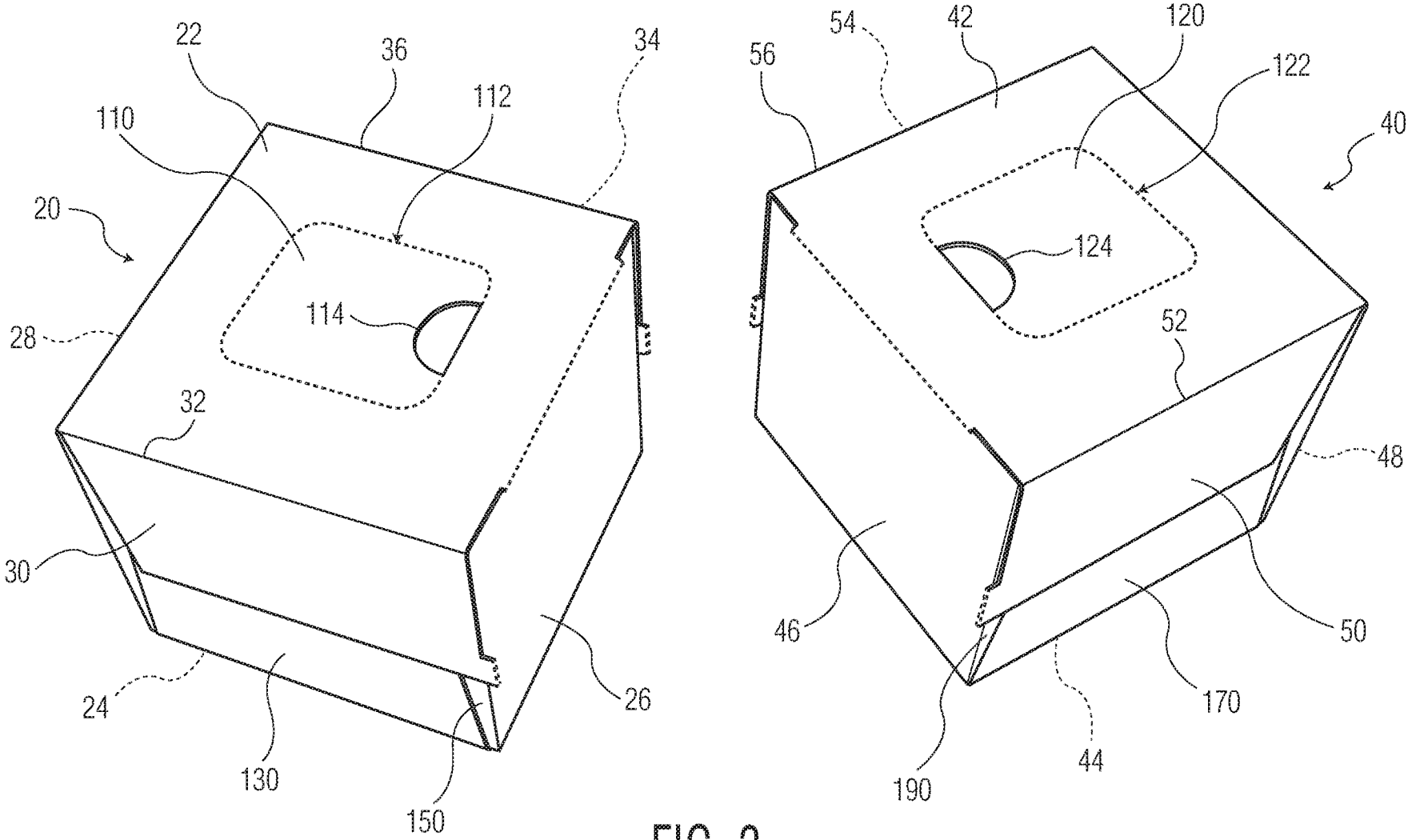
FIG. 3 is a perspective view illustrating the separated individual cartons.
Figure 4:
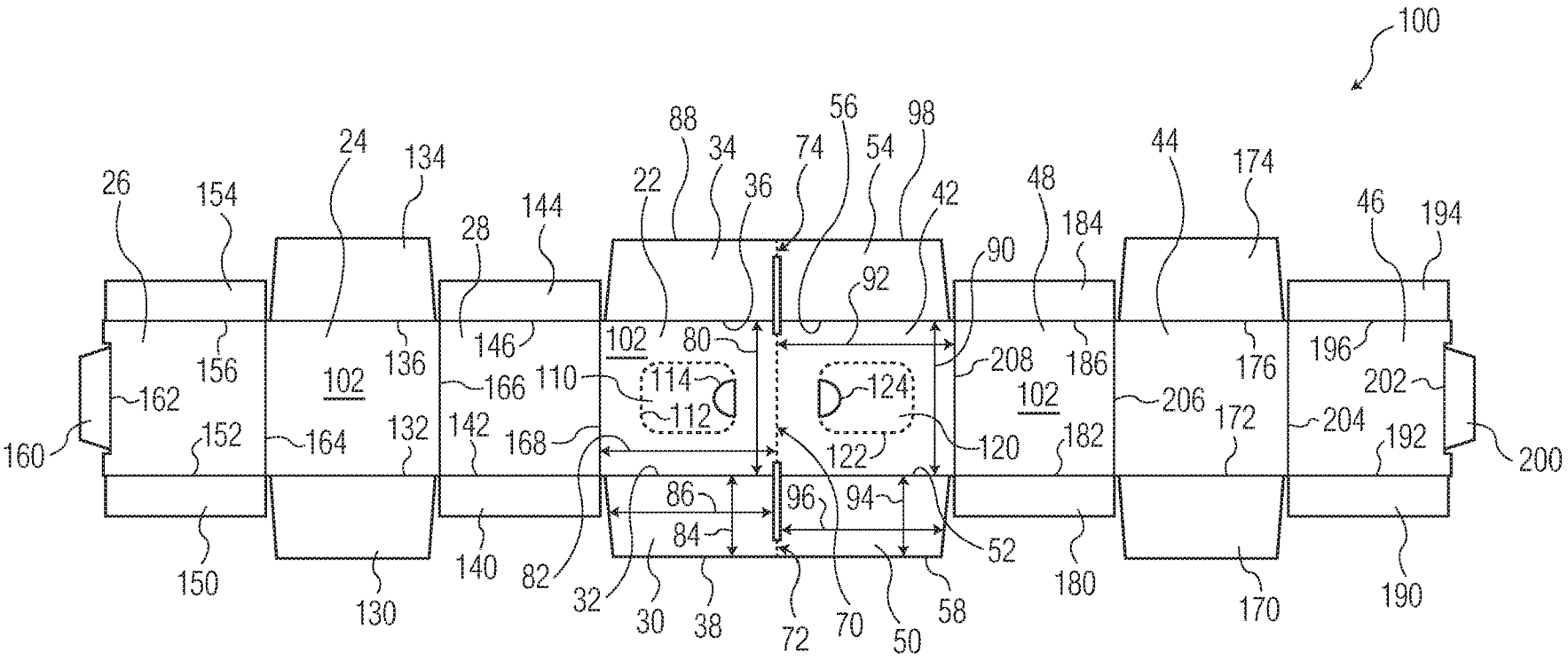
FIG. 4 is a plan view of an illustration of an embodiment of a blank for forming the multi-carton container.

The present disclosure is directed towards a multi-carton container which can be separated into two individual containers. Referring to FIGS. 1-4, FIG. 1 provides a perspective view of an illustration of an embodiment of a multi-carton container 10, FIG. 2 provides a bottom view of the multi-carton container 10 of FIG. 1, FIG. 3 provides a perspective view illustrating the separated individual cartons, 20 and 40, of the multi-carton container 10 of FIG. 1, and FIG. 4 illustrates a plan view of an illustration of an embodiment of a blank 100 for forming the multi-carton container 10. While the first carton 20 and the second carton 40 are illustrated as having the same overall size, dimension, and configuration, it is to be understood that the first carton 20 and the second carton 40 can be of different size, dimension, and configuration.

The multi-carton container 10 can have a first carton 20 and a second carton 40. The first carton 20 can have a top wall 22, a bottom wall 24, an inside wall 26, and an outside wall 28. The top wall 22 is parallel to the bottom wall 24 and perpendicular to each of the inside wall 26 and the outside wall 28. The first carton 20 can have an opposing pair of outermost side wall panels, 30 and 34, which can each be connected to the top wall 22 via fold lines, 32 and 36, respectively. As each of the outermost side wall panels, 30 and 34, can be connected to the top wall 22 via fold lines, 32 and 36, respectively, each of the outermost side wall panels, 30 and 34, can be perpendicular to the top wall 22 and the bottom wall 24. The second carton 40 can have a top wall 42, a bottom wall 44, an inside wall 46, and an outside wall 48. The top wall 42 is parallel to the bottom wall 44 and perpendicular to each of the inside wall 46 and the outside wall 48. The second carton 40 can have an opposing pair of outermost side wall panels, 50 and 54, which can each be connected to the top wall 42 via fold lines, 52 and 56, respectively. As each of the outermost side wall panels, 50 and 54, can be connected to the top wall 42 via fold lines, 52 and 56, respectively, each of the outermost side wall panels, 50 and 54, can be perpendicular to the top wall 42 and the bottom wall 44. The inside wall 26 of the first carton 20 and the inside wall 46 of the second carton 40 can be in a face-to-face relationship when the multi-carton container is in its fully formed configuration such as illustrated in FIG. 1.

The top wall 22 of the first carton 20 can have a first dimension, such as a length dimension 80, and a second dimension, such as a width dimension 82. The top wall 42 of the second carton 40 can have a first dimension, such as a length dimension 90, and a second dimension, such as a width dimension 92. The top wall 22 of the first carton 20 can abut the top wall 42 of the second carton 40 and can be at least partially connected to the top wall 42 of the second carton 40 along at least a portion of the length dimensions, 80 and 90, respectively, of each of the top walls, 22 and 42, respectively. In various embodiments, the length dimension, 80 and 90, of each of the top wall 22 of the first carton 20 and the top wall 42 of the second carton 40 is the same and the connection between the top wall 22 of the first carton 20 and the top wall 42 of the second carton 40 is less than the full length dimension, 80 and 90, of each of the top wall 22 of the first carton 20 and the top wall 42 of the second carton 40, respectively. In various embodiments, the connection between the top wall 22 of the first carton 20 and the top wall 42 of the second carton 40 is from about 10, 15, 20, 25, 30, 35, 40, 45, or 50% to about 55, 60, 65, 70, 75, 80, 85, or 90% of the length dimension, 80 and 90, of each of the top wall 22 of the first carton 20 and the top wall 42 of the second carton 40. In various embodiments, the connection between the top wall 22 of the first carton 20 and the top wall 42 of the second carton 40 is centered along the length dimensions, 80 and 90, of the top walls, 22 and 42, respectively. In various embodiments, the connection between the top wall 22 of the first carton 20 and the top wall 42 of the second carton 40 does not extend to the any of the fold lines, 32, 36, 52, and 56, between the top wall 22 of the first carton 20 and the outermost side wall panels, 30 and 34, of the first carton 20 and the top wall 42 of the second carton 40 and the outermost side wall panels, 50 and 54, of the second carton 40, respectively.

In various embodiments, the connection between the top wall 22 of the first carton 20 and the top wall 42 of the second carton 40 can have a line of weakness 70. A line of weakness 70 can facilitate the separation of the multi-carton container 10 into individual cartons, such as first carton 20 and second carton 40. In various embodiments, the line of weakness 70 can be formed by embossing or perforating dashed or dotted lines into the carton-forming material 102. The size (i.e., length and width) of the individual dashes and dots (broadly, "separation elements") that define the line of weakness 70 can be varied to alter the characteristics (i.e., resistance to separation) and appearance of the line of weakness 70. The spacing between the individual dashes and dots can also be varied for the same reasons. The characteristics of the line of weakness 70 can be altered by varying the size and/or spacing of the dashes/dots along the length of a single line of weakness 70. It is to be understood that the line of weakness 70 can be formed by embossing, cutting, perforating, bonding, mechanical thinning, or other processes as are known in the art. In various embodiments, the line of weakness 70 extends the full length of the connection between the top wall 22 of the first carton 20 and the top wall 42 of the second carton 40. In various embodiments, the line of weakness 70 can be a single line of weakness formed of separation elements. In various embodiments, the line of weakness 70 can be formed of two parallel lines of weakness formed of separation elements such that the line of weakness 70 can be a tear strip.

The outermost side wall panels, 30 and 34, of the first carton 20 can have a first dimension, such as a length dimension 84, and a second dimension, such as a width dimension 86. The outermost side wall panels, 50 and 54, of the second carton 40 can have a first dimension, such as a length dimension 94, and a second dimension, such as a width dimension 96. At least a portion of the outermost side wall panels, 30 and 34, of the first carton 20 can abut the outermost side wall panels, 50 and 54, of the second carton 40 and can be at least partially connected to the outermost side wall panels, 50 and 54, of the second carton 40 along at least a portion of the length dimensions, 84 and 94, respectively, of each of the outermost side wall panels, 30, 34, 50, and 54, respectively. In various embodiments, the length dimension, 84 and 94, of each of the outermost side wall panels, 30 and 34, of the first carton 20 and the outermost side wall panels, 50 and 54, of the second carton 40 is the same and the connection between the outermost side wall panels, 30 and 34, of the first carton 20 and the outermost side wall panels, 50 and 54, of the second carton 40 is less than the full length dimension, 84 and 94, of each of the outermost side wall panels, 30 and 34, of the first carton 20 and the outermost side wall panels, 50 and 54, of the second carton 40, respectively. In various embodiments, the connection between the outermost side wall panels, 30 and 34, of the first carton 20 and the outermost side wall panels, 50 and 54, of the second carton 40 is from about 10, 15, 20, 25, 30, 35, 40, 45, or 50% to about 55, 60, 65, 70, 75, 80, 85, or 90% of the length dimension, 84 and 94, of each of the outermost side wall panels, 30 and 34, of the first carton 20 and the outermost side wall panels, 50 and 54, of the second carton 40. In various embodiments, the outermost side wall panels, 30 and 34, of the first carton 20 can abut and be connected to the outermost side wall panels, 50 and 54, of the second carton 40 at any location along the length, 84 and 94, respectively, of the outermost side wall panels, 30, 34, 50, and 54, as deemed suitable. In various embodiments, the connection between the outermost side wall panels, 30 and 34, of the first carton 20 and the outermost side wall panels, 50 and 54, of the second carton 40, can begin at edges, 38 and 88 of the outermost side wall panels, 30 and 34, respectively, and at edges, 58 and 98 of the outermost side wall panels, 50 and 54, respectively, and extends in a direction towards the fold lines, 32, 36, 52, and 54, between the top wall 22 of the first carton 20 and the outermost side wall panels, 30 and 34, of the first carton 20 and the top wall 42 of the second carton 40 and the outermost side wall panels, 50 and 54, of the second carton 40. In various embodiments, the connection between the outermost side wall panels, 30 and 34, of the first carton 20 and the outermost side wall panels, 50 and 54, of the second carton 40 does not extend to the any of the fold lines, 32, 36, 52, and 56, between the top wall 22 of the first carton 20 and the outermost side wall panels, 30 and 34, of the first carton 20 and the top wall 42 of the second carton 40 and the outermost side wall panels, 50 and 54, of the second carton 40.

In various embodiments, the connection between the outermost side wall panels, 30 and 34, of the first carton 20 and the outermost side wall panels, 50 and 54, of the second carton 40 can have lines of weakness, 72 and 74, respectively. Lines of weakness, 72 and 74, can facilitate the separation of the multi-carton container 10 into individual cartons, such as first carton 20 and second carton 40. In various embodiments, the lines of weakness, 72 and 74, can be formed in the same manner as the line of weakness 70 described herein. In various embodiments, the lines of weakness, 72 and 74, extend the full length of the connection between the outermost side wall panels, 30 and 34, of the first carton 20 and the outermost side wall panels, 50 and 54, of the second carton 40. In various embodiments, the lines of weakness, 72 and 74, can be a single line of weakness formed of separation elements. In various embodiments, the lines of weakness, 72 and 74, can be formed of two parallel lines of weakness formed of separation elements such that the lines of weakness, 72 and 74, can each be a tear strip.

Each of the first carton 20 and the second carton 40 can contain a consumer product housed within the space formed when each wall forming the carton(s), 20 and 40, is placed into its appropriate configuration following folding of the blank 100 into the respective first carton 20 and second carton 40. In various embodiments, it may be desirable for a consumer to access such consumer product without having to separate any bond mechanism which is maintaining each wall into its appropriate configuration. In various embodiments, each of the top walls, 22 and 42, of the first carton 20 and second carton 40, respectively, can have a removable portion, 110 and 120, which can be removed from the top walls, 22 and 42, forming dispensing openings through which the consumer product can be removed from the first carton 20 and second carton 40, respectively. The removable portions, 110 and 120, can be of any size and shape deemed suitable to facilitate removal of consumer product contained within each of the first carton 20 and second carton 40 directly through the dispensing openings formed upon removal of the removable portions, 110 and 120. Examples of various suitable shapes of the removable portions, 110 and 120, can include, but are not limited to, square, rectangle, circle, oval, elliptical, etc.

Each of the removable portions, 110 and 120, can be bordered by a line of weakness, 112 and 122, respectively. The lines of weakness, 112 and 122, can facilitate the separation of the removable portions, 110 and 120, from the top walls, 22 and 42, of the first carton 20 and second carton 40, respectively. In various embodiments, the lines of weakness, 112 and 122, can be formed by embossing or perforating dashed or dotted lines into the carton-forming material 102 to define the shape and size of the removable portions, 110 and 120. The size (i.e., length and width) of the individual dashes and dots (broadly, "separation elements") that define the lines of weakness, 112 and 122, can be varied to alter the characteristics (i.e., resistance to separation) and appearance of the lines of weakness, 112 and 122. The spacing between the individual dashes and dots can also be varied for the same reasons. The characteristics of the lines of weakness, 112 and 122, can be altered by varying the size and/or spacing of the dashes/dots along the lengths of the lines of weakness, 112 and 122. It is to be understood that the lines of weakness, 112 and 122, can be formed in other ways besides embossing, including, cutting, perforating, bonding, mechanical thinning, or other processes as are known in the art.

In various embodiments, each of the removable portions, 110 and 120, can have a notch, such as notches 114 and 124, respectively, which can provide a consumer with the ability to grasp the material forming the removable portions, 110 and 120, and pull on such material thereby breaking the lines of weakness, 112 and 122, respectively, and causing a separation of the removable portions from the first carton 20 and the second carton 40, respectively. The notches, 114 and 124, can be any size and shape deemed suitable to accommodate a consumer extending at least a single finger (such as a pointer finger) through the opening created by a notch, 114 or 124, and pinching the material of the removable portion, 110 or 120, respectively, between the pointer finger and the consumer's thumb of the same handle and applying a pulling force on the removable portion, 110 or 120, in order to break the line of weakness, 112 or 122, respectively, and separate the removable portion, 110 or 120, from the first carton 20 or the second carton 40, respectively. In various embodiments, the removable portions, 110 and 120, may be provided with tabs, instead of a notch, that a consumer may grasp and apply a pulling force on in order to break the lines of weakness, 112 and 122, respectively, to separate the removable portions, 110 and 120, from the first carton 20 and second carton 40, respectively.

In various embodiments, removal of the removable portions, 110 and 120, may provide the consumer with direct access to the consumer product contained within the first carton 20 and/or the second carton 40, respectively. In various embodiments, a barrier may be provided to each of the first carton 20 and/or the second carton 40. Such a barrier may reduce and/or prevent soil, dirt, and/or other contaminant from entering the first carton 20 and/or second carton 40 and coming into contact with the consumer product contained therein. In various embodiments, the barrier can be a flexible, thin plastic film which can span across or over the dispensing opening which will be revealed by the separation of the removable portion, 110 and 120, from the top wall 22 of the first carton 20 and the top wall 42 of the second carton 40, respectively.

The top wall 22 of the first carton 20 and the top wall 42 of the second carton 40 each have an exterior surface which is exposed to the environment surrounding the first carton 20 and the second carton 40 as well as an interior surface which will come into contact with the consumer product housed within each of the first carton 20 and the second carton 40. In various embodiments, the barrier can be attached to the exterior surface of the top wall 22 of the first carton 20 and the exterior surface of the top wall 42 of the second carton 40. In various embodiments, the barrier can be attached to the interior surface of the top wall 22 of the first carton 20 and the interior surface of the top wall 42 of the second carton 40. In various embodiments in which a barrier is utilized it can be formed of a material that can either be at least partially removed or ruptured by the consumer. In various embodiments, the barrier can have a configuration in which neither rupturing nor removal is required in order to obtain access to the product within the carton, 20 and/or 40. In various embodiments in which the barrier can be at least partially removed, the barrier can be attached to the exterior surface of the top wall, 22 or 42, of the first carton 20 or second carton 40 and attached to the removable portion, 110 or 120, respectively. In such embodiments, the attachment of the barrier to the removable portion, 110 or 120, can be stronger than the attachment of the barrier to the exterior surface of the top wall, 22 or 42, such that the barrier is pulled away from the exterior surface of the top wall, 22 or 42, during the separation and removal of the removable portion, 110 or 120, respectively. In various embodiments in which the barrier can be at least partially removed, the barrier can be attached to the exterior surface or the interior surface of the top wall, 22 or 42, and attached to the removable portion, 110 or 120, respectively. In such embodiments, the barrier can have a line of weakness surrounding the portion of the barrier which is attached to the removable portion, 110 or 120. In such embodiments, when the removable portion, 110 or 120, is separated from the first carton 20 or second carton 40, the act of separation of the removable portion, 110 or 120, can impose a pulling force on the attached barrier which can cause a rupture of the line of weakness surrounding the portion of the barrier attached to the removable portion, 110 or 120, and such portion of the barrier can be separated from the first carton 20 or second carton 40. In various embodiments, the barrier can be ruptured by the consumer following removal of the removable portions, 110 or 120. The rupturing of the barrier can be accomplished by incorporating breakable slits into the barrier. The incorporation of the breakable slits into the barrier will maintain the positioning of the barrier material, however, a dispensing opening will be available to the consumer following rupturing of the breakable slits. In such embodiments, the barriers, such as, for example, the flexible, thin plastic films, can be provided with a dispensing opening which can either be a single slit or can be provided in various cross or x-shaped configurations as are disclosed in U.S. Pat. No. 5,415,320, issued to North et al., and which is incorporated herein by reference and made a part hereof to the extent it does not conflict with the disclosure herein. In various embodiments, a barrier can be formed from two sheets of material, such as flexible, thin plastic films, which can be provided in either an edge-to-edge configuration or in an overlapping configuration. In either of such configurations, a consumer can push the material forming the barrier aside to obtain access to the product within the carton, 20 and/or 40, without having to either rupture or remove the actual barrier.

In various embodiments, the multi-carton container 10 can be formed from a blank 100 of a foldable sheet material 102 such as paperboard, coated cardboard, corrugated board, or any other appropriate material deemed suitable. Hot melt or chemical adhesive can be utilized to adhere portions of the material 102 together during the formation of each of the first carton 20 and the second carton 40 as well as the multi-carton container 10.

In various embodiments, the blank 100 can have primary panels for forming the first carton 20 or the second carton 40 of the multi-carton container 10. The primary panels of the blank 100 will form the top walls, 22 and 42, bottom walls, 24 and 44, inside walls, 26 and 46, and outside walls, 28 and 48, of the first carton 20 and second carton 40, respectively, of the multi-carton container 10. One of the primary panels, such as, for example, the central panel of the blank 100, can form each of the top walls, 22 and 42, of the first carton 20 and second carton 40, respectively. To form each of the top wall 22 of the first carton 20 and the top wall 42 of the second carton 40, a line of weakness 70 can be incorporated into the central panel of the blank 100. In various embodiments, the line of weakness 70 can be incorporated into the central panel via any method deemed suitable such as embossing, cutting, perforating, bonding, mechanical thinning, or any other process deemed suitable, to provide separation elements into the central panel of the blank 100 which will ultimately enable a consumer to separate a first carton 20 from a second carton 40 of the multi-carton container 10.

The central panel of the blank 100 is hingedly connected via fold line 168 to a primary panel of the blank 100 which will ultimately become outside wall 28 of the first carton 20. The primary panel forming outside wall 28 of the first carton 20 is hingedly connected via fold line 166 to a primary panel of the blank 100 which will ultimately form the bottom wall 24 of the first carton 20 which, in series, is then hingedly connected via fold line 164 to the primary panel of the blank 100 which will ultimately become the inside wall 26 of the first carton 20. The primary panel forming the inside wall 26 of the first carton 20 can be hingedly connected via fold line 162 to flange 160. The flange 160 can be attached to the interior surface of the top wall 22 of the first carton 20 via any form of attachment deemed suitable such as, for example, an adhesive.

The central panel of the blank 100 is also hingedly connected via fold line 208 to a primary panel of the blank 100 which will ultimately become outside wall 48 of the second carton 40. The primary panel forming outside wall 48 of the second carton 40 is hingedly connected via fold line 206 to a primary panel of the blank 100 which will ultimately form the bottom wall 44 of the second carton 40 which, in series, is then hingedly connected via fold line 204 to the primary panel of the blank 100 which will ultimately become the inside wall 46 of the second carton 40. The primary panel forming the inside wall 46 of the second carton 40 can be hingedly connected via fold line 202 to flange 200. The flange 200 can be attached to the interior surface of the top wall 42 of the second carton 40 via any form of attachment deemed suitable such as, for example, an adhesive.

Each of the primary panels of the blank 100 is connected to at least one secondary panel which can be utilized in forming the first carton 20 or the second carton 40 of the multi-carton container 10. The portion of the central panel of the blank 100 forming the top wall 22 of the first carton 20 can be hingedly connected via fold line 32 to a secondary panel which will ultimately become outermost side wall panel 30 of the first carton 20 as well as being hingedly connected via fold line 36 to a secondary panel which will ultimately become outermost side wall panel 34 of the first carton 20. The primary panel forming the outside wall 28 of the first carton 20 can be hingedly connected, via fold lines 142 and 146, to secondary panels 140 and 144. The primary panel forming the bottom wall 24 of the first carton 20 can be hingedly connected, via fold lines 132 and 136, to secondary panels 130 and 134. The primary panel forming the inside wall 26 of the first carton 20 can be hingedly connected, via fold lines 152 and 156, to secondary panels 150 and 154. Each of the secondary panels, 130, 134, 140, 144, 150, and 154, can ultimately become inner side wall panels of the first carton 20. In various embodiments, secondary panels 130, 140, and 150 can be placed into any overlapping configuration with each other as deemed suitable and which will ultimately be overlapped by the secondary panel forming the outermost side wall panel 30 of the first carton 20. The overlapping configuration of the secondary panels 30, 130, 140, and 150 can form a first side wall of the first carton 20. Overlapping secondary panels 134, 144, and 154 can be placed into any overlapping configuration with each other as deemed suitable and which will ultimately be overlapped by the secondary panel forming the outermost side wall panel 34 of the first carton 20. The overlapping configuration of the secondary panels 34, 134, 144, and 154 can form a second side wall of the first carton 20 parallel with the first side wall of the first carton 20.

The portion of the central panel of the blank 100 forming the top wall 42 of the first carton 40 can be hingedly connected via fold line 52 to a secondary panel which will ultimately become outermost side wall panel 50 of the second carton 40 as well as being hingedly connected via fold line 56 to a secondary panel which will ultimately become outermost side wall panel 54 of the second carton 40. The primary panel forming the outside wall 48 of the second carton 40 can be hingedly connected, via fold lines 182 and 186, to secondary panels 180 and 184. The primary panel forming the bottom wall 44 of the second carton 40 can be hingedly connected, via fold lines 172 and 176, to secondary panels 170 and 174. The primary panel forming the inside wall 46 of the second carton 40 can be hingedly connected, via fold lines 192 and 196, to secondary panels 190 and 194. Each of the secondary panels, 170, 174, 180, 184, 190, and 194, can ultimately become inner side walls of the second carton 40. In various embodiments, secondary panels 170, 180, and 190 can be placed into any overlapping configuration with each other as deemed suitable and which will ultimately be overlapped by the secondary panel forming the outermost side wall panel 50 of the second carton 40. The overlapping configuration of the secondary panels 50, 170, 180, and 190 can form a first side wall of the second carton 40. Overlapping secondary panels 174, 184, and 194 can be placed into any overlapping configuration with each other as deemed suitable and which will ultimately be overlapped by the secondary panel forming the outermost side wall panel 54 of the second carton 40. The overlapping configuration of the secondary panels 54, 174, 184, and 194 can form a second side wall of the second carton 40 parallel with the first side wall of the second carton 40.

In the interests of brevity and conciseness, any ranges of values set forth in this disclosure contemplate all values within the range and are to be construed as support for claims reciting any sub-ranges having endpoints which are whole number values within the specified range in question. By way of hypothetical example, a disclosure of a range of from 1 to 5 shall be considered to support claims to any of the following ranges 1 to 5; 1 to 4; 1 to 3; 1 to 2; 2 to 5; 2 to 4; 2 to 3; 3 to 5; 3 to 4; and 4 to 5.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description are, in relevant part, incorporated herein by reference; the citation of any documents is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Many modifications and variations of the present disclosure can be made without departing from the spirit and scope thereof. Therefore, the exemplary embodiments described above should not be used to limit the scope of the invention.

What is claimed is:

1. A multi-carton container comprising:

a first carton comprising a first top wall which has a first length dimension, a first bottom wall, a first inside wall, and a first outside wall, the first top wall being parallel to the first bottom wall and perpendicular to each of the first inside wall and the first outer wall, a first outermost side wall panel which has a second length dimension and which is connected to the first top wall along a first fold line, a second outermost side wall panel which has a third length dimension and which is connected to the first top wall along a second fold line, the first outermost side wall panel and the second outermost side wall panel each being perpendicular to the first top wall;

a second carton comprising a second top wall which has a fourth length dimension, a second bottom wall, a second inside wall, and a second outside wall, the second top wall being parallel to the second bottom wall and perpendicular to each of the second inside wall and the second outer wall, a third outermost side wall panel which has a fifth length dimension and which is connected to the second top wall along a third fold line, a fourth outermost side wall panel which has a sixth length dimension and which is connected to the second top wall along a fourth fold line, the third outermost side wall panel and the fourth outermost side wall panel each being perpendicular to the second top wall;

wherein the first top wall is at least partially connected to the second top wall along a first line of weakness which is less than the full length dimension of each of the first length dimension of the first top wall and the fourth length dimension of the second top wall and which does not extend to either the first fold line or the second fold line and wherein the first outermost side wall panel is at least partially connected to the third outermost side wall panel along a second line of weakness which is less than the full length dimension of each of the second length dimension of the first outermost side wall panel and the fifth length dimension of the third outermost side wall panel, and wherein the second outermost side wall panel is at least partially connected to the fourth outermost side wall panel along a third line of weakness which is less than the full length dimension of each of the third length dimension of the second outermost side wall panel and the sixth length dimension of the fourth outermost side wall panel; and wherein the first top panel has a first removable portion to reveal a first dispensing opening and wherein the second top panel has a second removable portion to reveal a second dispensing opening.

2. The container of claim 1 wherein the first inside wall is hingedly connected to a first flange and wherein the first flange is attached to the first top panel.

3. The container of claim 1 wherein the second inside wall is hingedly connected to a second flange and wherein the second flange is attached to the second top panel.

4. The container of claim 1 wherein the first line of weakness is formed by separation elements.

5. The container of claim 1 wherein the first line of weakness comprises a pair of parallel lines of weakness forming a tear strip.

6. The container of claim 1 wherein the container is made from a single blank.

7. The container of claim 1 wherein the first removable portion comprises a notch.

8. The container of claim 1 wherein the second removable portion comprises a notch.

9. The container of claim 1 wherein the first carton further comprises a first barrier positioned over the first dispensing opening.

10. The container of claim 1 wherein the second carton further comprises a second barrier positioned over the second dispensing opening.

* * * * *